United States Patent [19]

Eaton et al.

[11] Patent Number: 4,787,138

[45] Date of Patent: Nov. 29, 1988

[54] METHOD AND APPARATUS FOR CONTACT INSERTION

[75] Inventors: Homer L. Eaton, Leucadia; Goro Kambara, Valley Center, both of Calif.

[73] Assignee: MTS Systems Corporation, Eden Prairie, Minn.

[21] Appl. No.: 27,939

[22] Filed: Mar. 19, 1987

Related U.S. Application Data

[63] Continuation-in-part of Ser. No. 646,949, Sep. 4, 1984, Pat. No. 4,658,503.

[51] Int. Cl.[4] ..... G23P 19/04

[52] U.S. Cl. ..... 29/748; 29/759

[58] Field of Search ..... 29/748, 749, 755, 759

[56] References Cited

U.S. PATENT DOCUMENTS

| | | | |
|---|---|---|---|
| 4,308,659 | 1/1982 | Brandewie et al. | 29/748 |
| 4,638,558 | 1/1987 | Eaton | 29/861 |
| 4,658,503 | 4/1957 | Eaton | 29/854 |

FOREIGN PATENT DOCUMENTS

| | | | |
|---|---|---|---|
| 54-99994 | 8/1979 | Japan | 29/748 |

*Primary Examiner*—P. W. Echols
*Assistant Examiner*—Joseph M. Gorski
*Attorney, Agent, or Firm*—Gausewitz, Carr & Rothenberg

[57] ABSTRACT

A contact on the end of a wire is inserted into an aperture of a multi-pin connector by a traveling insertion head that moves in three dimensions to fetch the wire from a wire holder, pull it from the holder and drive it into a selected aperture of the connector. The head moves back toward a wire to insert the wire end contact between a pair of rotating wire drive rollers which grasp the contact and wire to position the contact wholly within a protective insertion quill. The insertion head is then driven into alignment with a selected connector aperture, slightly inserts the quill into the aperture while the contact is fully protected, and the wire drive rollers are rotated to drive the contact and wire through the quill into the connector. A pull test is provided by pivotally retracting the rollers which still grasp the wire. The rollers and quill are withdrawn and opened to enable the rollers and quill to move laterally off the now connected wire to prepare for fetching the next wire. A plurality of turret mounted quills are selectively aligned with the rollers to accommodate different size and style of wires and contacts. To ensure alignment of the connector grommet aperture and to facilitate driving of the contact into the connector, the head may be oscillated a small amount in several directions in a plane parallel to the face of the connector while the quill is partly inserted into the connector grommet aperture. Precise and stable location of the head for alignment with a selected connector aperture is accomplished by mounting the rollers and quill by a simple but rigid set of pivoting precision links, including a fixed length link and two variable length links.

24 Claims, 10 Drawing Sheets

14
12
10
368
334
351
335
354
318
356
288
490
368
369
18
16
12
373
343
414
432
412
202
448
444
206
350
358
316
314
282
152
208
190
194
263
256
264
254
258
250
408
410
412
132
286
280
287
290
144
188
146
244
246
148
192
196
182
185
58
54
56
10

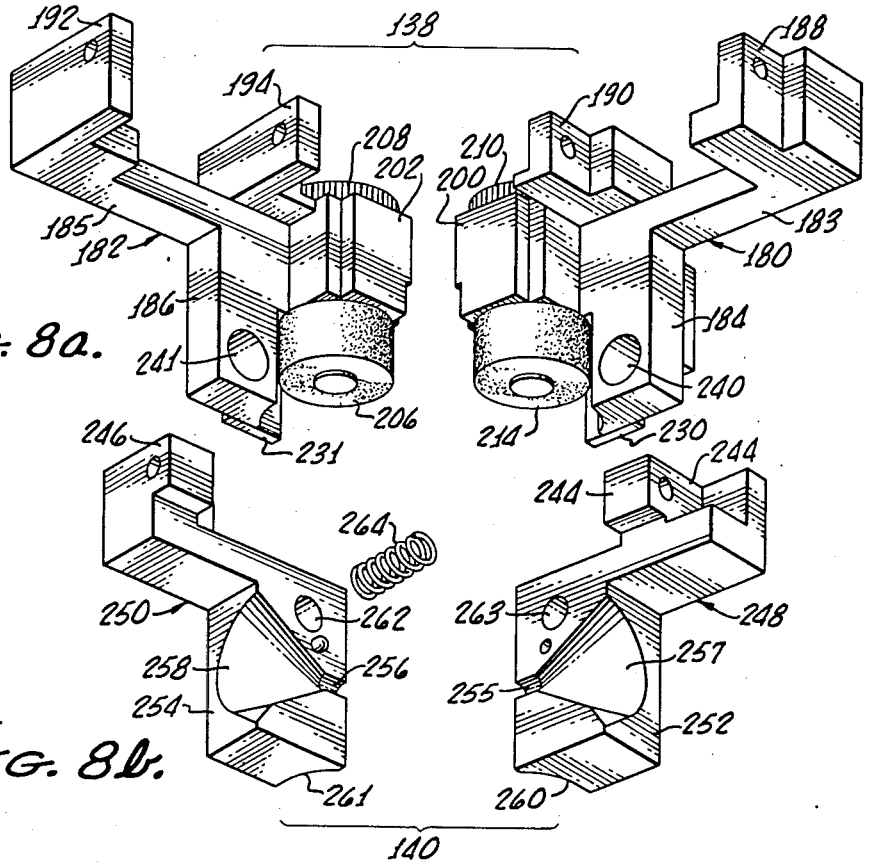
FIG. 8a.
FIG. 8b.
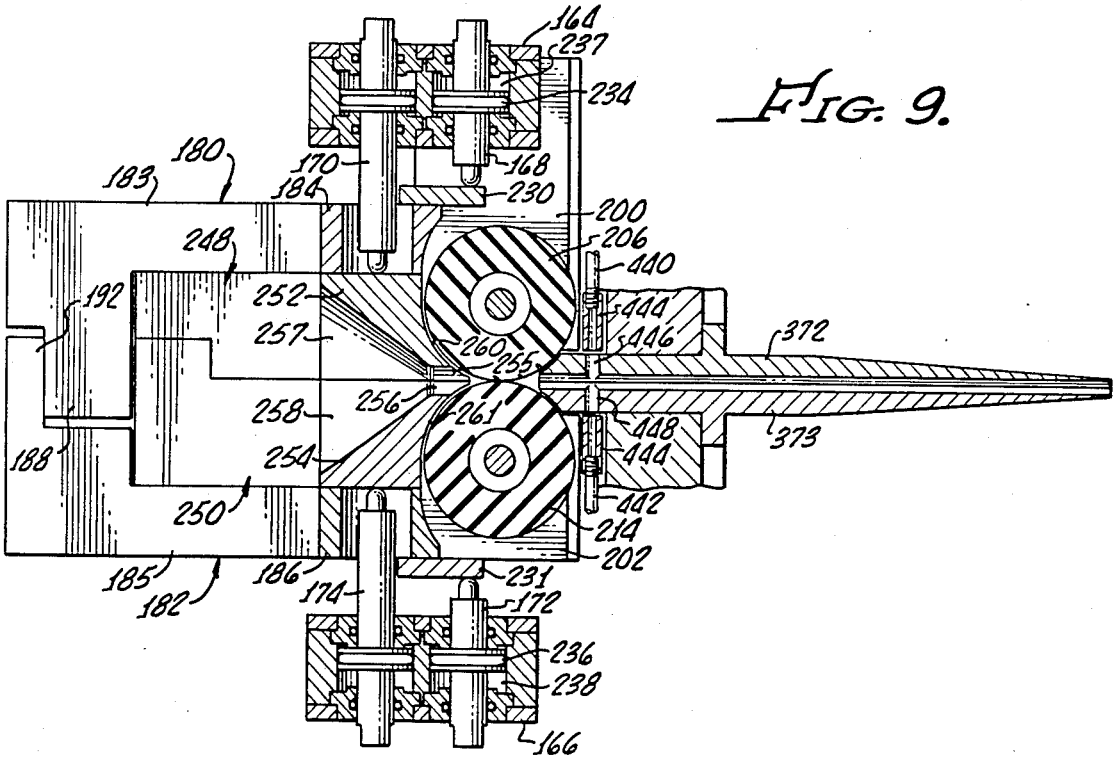
FIG. 9.

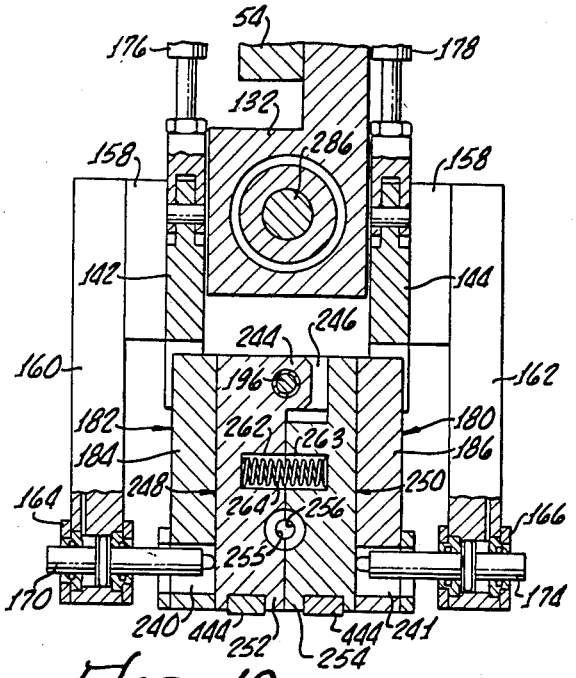
FIG. 10.
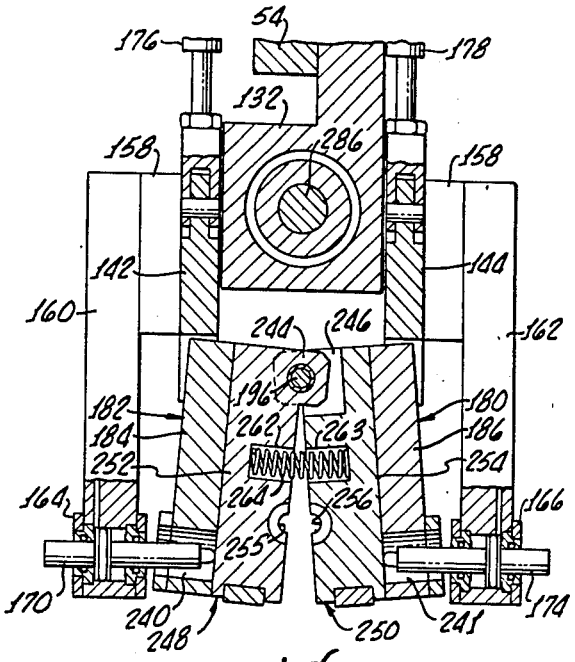
FIG. 11.
FIG. 14.
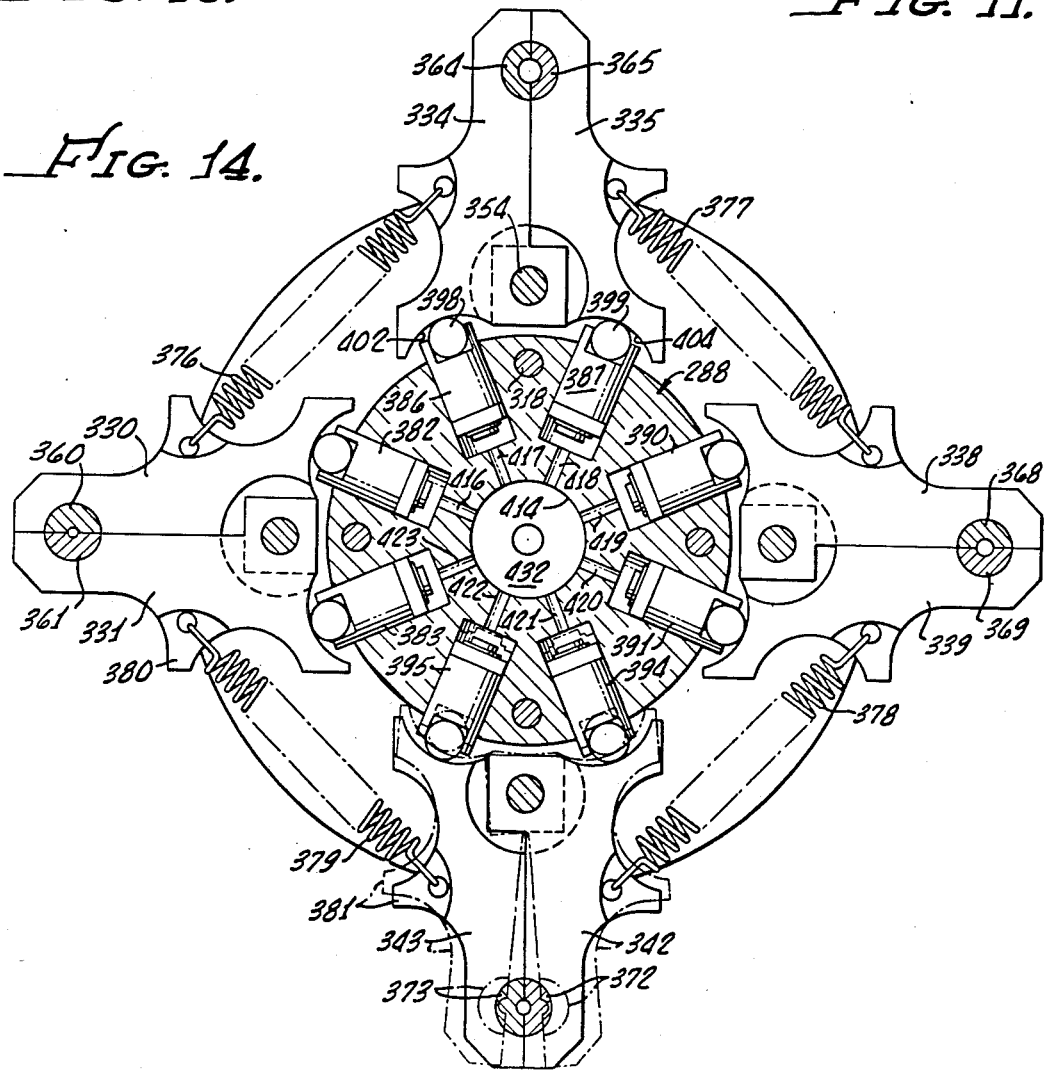

METHOD AND APPARATUS FOR CONTACT INSERTION

This application is a continuation-in-part of the co-pending application of Homer L. Eaton for Method and Apparatus For Terminal Insertion, Ser. No. 646,949, filed Sept. 4, 1984, now U.S. Pat. No. 4,658,503 and assigned to the assignee of the present application. The disclosure of such co-pending application is incorporated by this reference just as though as fully set forth herein.

BACKGROUND OF THE DISCLOSURE

The present invention relates to methods and apparatus for inserting wires into connectors, and more particularly concerns improvements in the insertion of one end of a contact terminated wire into an aperture of a multi-pin connector.

Electrical wire harnesses embody a number of wires, each having a terminal or contact affixed to one or both of its ends. The wires are connected to and between different pairs of multiple pin connectors. Optical fibers, carrying optical signals, and having greater information carrying capacity, are replacing electrical connectors in some applications. Such optical energy conductors are assembled and connected in arrangements similar to those employed for electrical conductors. Accordingly, the term "wire" as used throughout the description and claims, denotes either electrical or optical energy conductors.

The method and apparatus of above mentioned application Ser. No. 646,949 are directed to an automatic insertion of a wire contact or terminal into the aperture of a multi-pin connector, even where a large number of tightly packed, high density wires are present, having been previously connected to the same connector. The contact on the end of the wire is long, thin and delicate. Thus, after many of the wires have been connected to the connector, the next contact to be inserted must be forced between wires of the bundle of closely packed wires that have been previously connected. Moreover, the contact must be precisely aligned with the connector aperture as it is automatically inserted, because damage to the slender contact may result if it is not precisely aligned with the receiving aperture during insertion. The connector has a flexible face grommet having many holes which tend to become misaligned with the corresponding connector holes as more and more wire contacts are inserted. In many cases the grommet aperture must be realigned to minimize damage to the contact upon insertion of the contact through the grommet hole into the connector hole.

The method and apparatus of the prior application incorporate a traveling insertion head having a pair of wire drive rollers and a protective sheath in the form of an insertion quill. The head is moved to a wire that is to be inserted into a connector, and the wire is grasped by the rollers and located with its slender contact completely enclosed in the quill. With the contact completely enclosed, the insertion head, bearing the rollers and quill and the wire and contact held thereby, is moved so as to locate the end of the quill at or slightly into a specific aperture in which the contact is to be inserted. The rollers then are rotated to drive the wire and contact through the quill into the connector.

The apparatus of the prior application is also arranged to travel the length of the wire after a first end has been inserted into the connector, without releasing the wire from its grasp. On reaching the other end of the wire, the roller and drive structure rotates 180°, positions the other end of the wire and the contact thereon into the protective insertion quill and proceeds to insert this second end into a second connector, thereby routing and completing connection of both ends of one of a number of wires that are routed along a particular path to form a wire harness of a desired configuration.

Although the apparatus and method of the prior application are efficient and satisfactory in many respects, improvement is still desired. Thus the insertion apparatus and method of the prior application have been modified in accordance with principles of the present invention to provide apparatus and methods which retain many desirable features of the prior application but which also have a number of advantages. Improved wire contact insertion as described herein provides a greater precision and rapidity of positioning of a wire and insertion quill by the use of a greatly improved and novel traverse mechanism. Speed, stability and efficiency of operation are enhanced by an unique structure and configuration of drive rollers and quill. Versatility of the apparatus and method, including its ability to handle wires and contacts of different types, sizes and configurations, is significantly improved by the provision of a number of selectively operable turret mounted protective quills and a novel arrangement of wire roller drive frame and guide funnel parts. Wire contact insertion is facilitated by unique vibratory manipulation of the quill and by a reciprocating drive for the wire in certain situations.

Because, in many applications, the first ends of each of a large number of wires are all inserted into a single connector before any further operations are carried out with respect to the other ends of the wires of such a bundle, the apparatus and method of the present invention primarily is directed toward insertion only of a first end of each wire into the apertures of a multi-pin, high density connector. Nevertheless, it will readily be appreciated that principles of this inention may be employed for inserting the second ends of wires of which the first ends are already inserted.

SUMMARY OF THE INVENTION

In carrying out principles of the present invention in accordance with a preferred embodiment thereof, pairs of wire drive roller frame parts and funnel parts are movably mounted to close so as to guide a wire contact and wire through the closed funnel to and between the closed rollers to enable driving of the wire and contact by rotation of the rollers, and to enable the parts to open and allow lateral removal from the wire after the wire contact has been inserted in a connector. The assembly of rollers and funnel parts is movably mounted so as to move with components of motion along the wire toward and away from the end of a hollow protective quill, which is positioned to receive the contact driven from the rollers.

According to a feature of the invention, the quill is one of several mounted on a movable quill base for selectively positioning one or the other of the quills for operative cooperation with the drive rollers. Simple pivotal motion of the assembly of wire drive roller and funnel parts enables a simplified pull test to be carried out. Closing of the rollers brings them into contact with a roughly positioned quill and shifts the quill base to more precisely align the quill with the rollers.

Accordingly to another feature of the invention, and particularly for those wire contacts which encounter difficulties in connection, the forward end of the quill, when partly inserted into the front of a connector opening during contact insertion, is vibrated in several directions which extend radially of the axis of the connector aperture, and the contact and wire may be reciprocated longitudinally fowardly and rearwardly as they are advanced into the connector aperture.

As another feature of the invention, the wire drive roller frame parts and funnel parts are so positioned that the rollers parts may be opened independently of the funnel parts to accept a wire or wire and contact of larger diameter. More specifically, according to this feature, the roller parts may be opened either by opening the funnel parts, which cause opening of the wire drive roller parts, or if the funnel parts remain closed, insertion of a contact or wire between the rollers may be allowed to drive these apart so as to accept a larger diameter wire.

Increased precision of roller and quill alignment with the connector aperture, greater stability and rigidity of the moving parts, and ease of programming and control are provided by an unique traversing head that positions the drive rollers, funnel and quill at a selected point in a plane parallel to the face of the connector by constraining one point on the working head (which carries the rollers and quills) to move in a circular arc about a fixed axis and varying first and second distances between another point on the working head and respective ones of a first fixed axis and a second fixed axis spaced from the first fixed axis. More specifically, the working head is movably connected to a carriage that is driven into alignment with a selected connector aperture by a linkage comprising a first fixed length link and a pair of extensible links whose lengths are selectively varied to achieve desired precise positioning.

BRIEF DESCRIPTION OF THE DRAWINGS

FIGS. 8*a* and 8*b* are pictorial illustrations of the two relatively pivoted parts of the wire drive roller frame and of the funnel block, respectively, separated and tilted outwardly to show the mutually facing portions of the mating parts.

FIG. 9 is a plan view looking up at the bottom of the insertion head, showing a relation between wire entrance funnel, drive rollers, and quill.

FIGS. 10 and 11 are sections taken on lines 10—10 of FIG. 6 showing the funnel parts in closed and open positions respectively.

FIG. 14 is a section taken on lines 14—14 of FIG. 6 showing details of the quill turret.

DETAILED DESCRIPTION OF THE INVENTION

Figure 1:
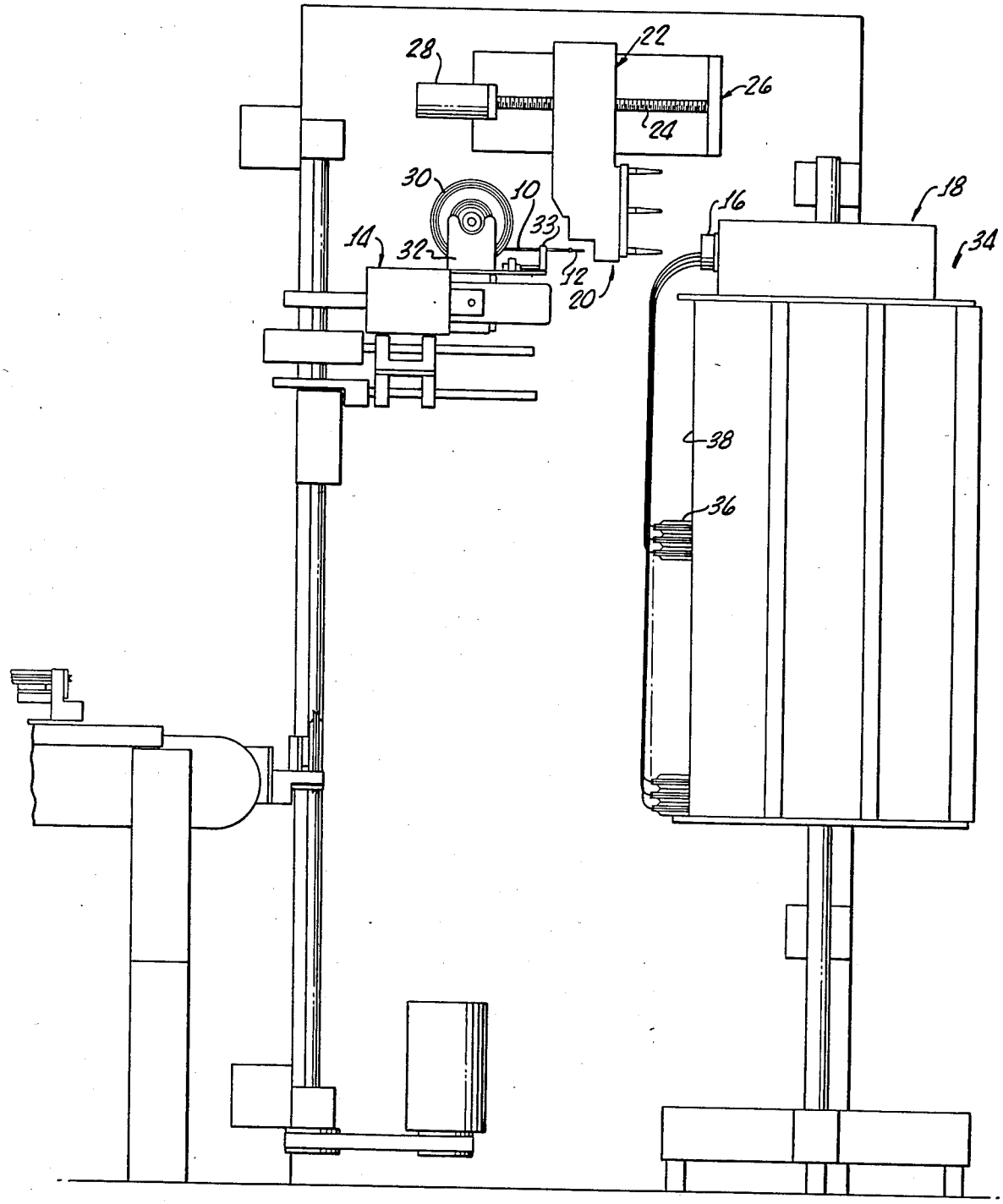
FIG. 1 is a simplified illustration showing a wire holding structure and a connector holding structure with insertion apparatus embodying principles of the present invention mounted to pick up the wire and insert it into the connector.

Illustrated in FIG. 1 is an exemplary application of an insertion apparatus and method embodying principles of the present invention. This figure is presented to explain an environment in which the insertion apparatus of the present invention may be used. A wire 10, having an end contact or terminal 12, is held in a fixed position on a wire holder 14 and is to have its contact 12 inserted into one of the apertures of a connector 16 mounted on a fixed support 18. The wire end is picked up from its holder 14 and moved to and inserted into the connector aperture by means of an insertion head 20, movably mounted on a carriage 22, which in turn traverses toward and away from the connector 16 along a screw and guide 24 mounted to a fixed support 26 and under control of a traversing drive motor 28.

Although many types of wire holders may be employed in connection with the present invention, in a specific embodiment, a small reel 30 has wound thereon a length of wire 10 from which one or both ends project and having a contact or contacts fixed to one or both ends. The reel is rotatably carried in a support 32, which during contact pick-up and insertion, is rigidly and fixedly positioned to facilitate the motion of insertion head 20 toward the wire to pick up the terminal for insertion. Preferably the rotational mounting of the reel has sufficient friction, or other rotational restraint, to hold the reel in a selected rotational position and thus hold the wire in a selected position for capture by the wire drive assembly. The wire is initially held, for pickup by the insertion head 20, in a clamp 33 of holder 14. However, the reel mounting allows the reel to rotate in response to the pull exerted by withdrawal of the wire from the reel after it has been released by the clamp and grasped by the wire drive assembly. The connector support 18 in a presently preferred embodiment, takes the form of an upright carousel 34, mounted for rotation about a vertical axis but fixedly positioned relative to fixed support at all times during the insertion process. After the wire terminal has been inserted in an appropriate connector aperture and the insertion head 20 withdrawn from the connector and removed from the wire, the support 32 is moved so as to insert reel 30 on to the top of a stack 36 of reels arranged one on top of the other within a vertically extending, laterally opening slot 38 in the body of carousel 34. Further details of the reel 30 and carousel 34 are shown in copending applications Ser. No. 615,933, filed May 31, 1984 for Wire Processing Method and Apparatus, and Ser. No. 748,339, filed June 24, 1985, for Reel and Reel Handling System, both by Homer L. Eaton and assigned to the assignee of the present applications.

Figure 2:
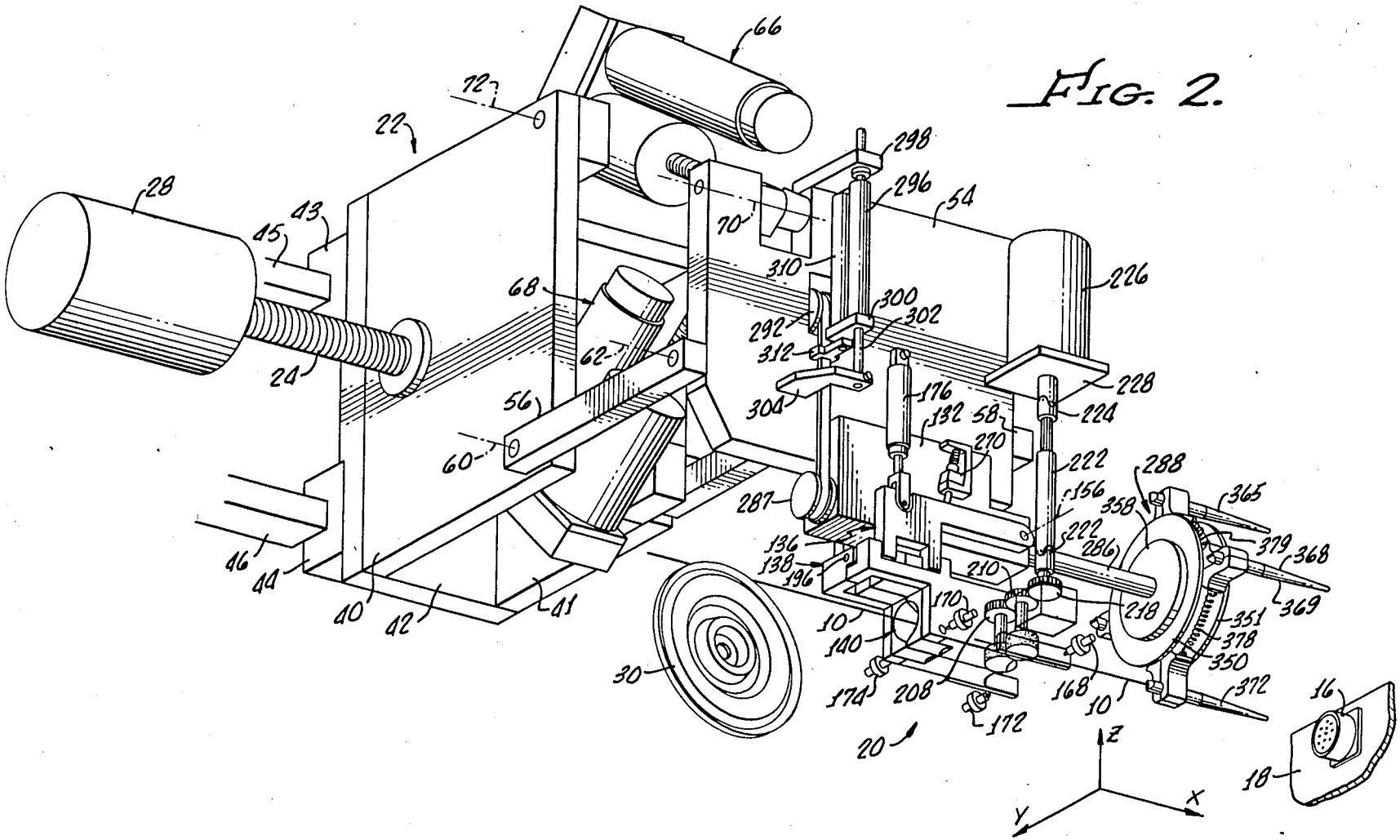
FIG. 2 is a simplified pictorial illustration of an insertion head embodying principles of the invention, with the showing of the parts distorted by elongation along a substantially horizontal axis in order to better show configuration and relation of the various parts.

The insertion head and its traversing carriage are shown in a distorted pictorial view in FIG. 2, with the various parts shown elongated in the direction of the X axis for clarity of the illustration. Connector 16, fixedly mounted on support 18, is oriented so that the axes of the several connector apertures are aligned along the X axis of an X,Y,Z coordinate system illustrated in FIG. 2, with the connector face being parallel to the Y,Z plane. Traversing carriage 22 is formed of a pair of side plates 40,41 mutually spaced and interconnected by a back plate 42 and bearing guide channels 43,44 extending in the X direction, which slidably receive upper and lower mutually spaced fixed guide bars 45,46 which slidably mount the carriage to a fixed support (not shown in FIG. 2) which bears the guide bars 45,46, for motion along the X axis, toward and away from the connector 16. The carriage carries a nut (not shown) which threadedly receives traversing screw 24 driven by fixedly mounted motor 28 to effect the X axis drive.

Y,Z DRIVE

Figure 3:
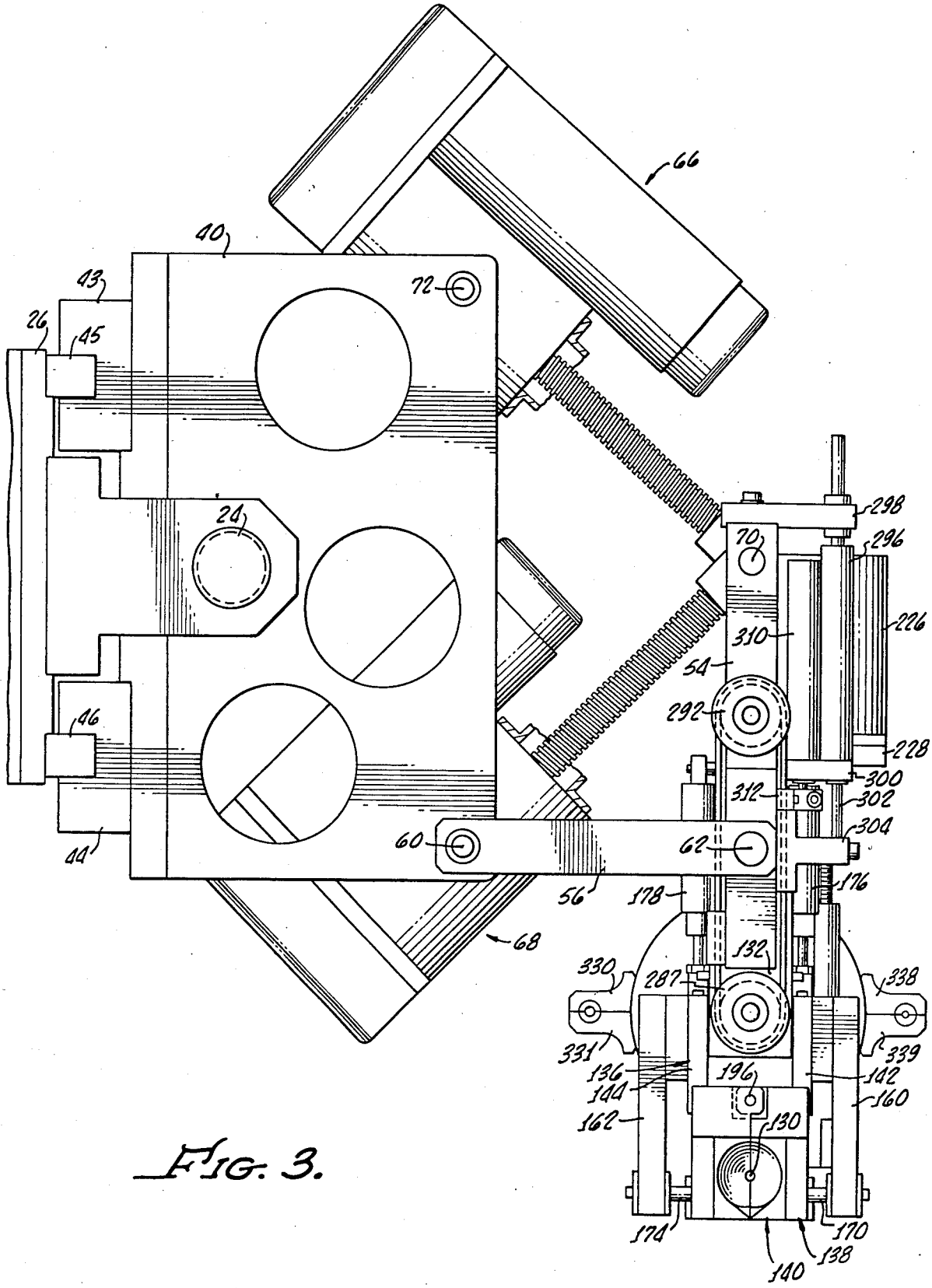
FIG. 3 is a front elevational view of the insertion head of FIGS. 1 and 2, with parts broken away.

An insertion head base plate 54 is movably mounted to the X-axis traversing carriage for motion in the Y,Z plane by means of a pair of fixed length links 56,58 pivoted to the carriage side plates 40,41 about a common axis 60 extending parallel to X and pivoted to opposite edges of the base plate 54 about an axis 62, which is also parallel to X. First and second variable length links in the form of servo struts 66,68 are pivotally connected to one another at a common end thereof and to the insertion head base plate about a common axis 70, also parallel to X. Servo strut 66 is pivotally connected at its other end to and between side plates 40,41 on an axis 72 also parallel to X, and servo strut 68 is pivoted to and between the side plates at its other end on the axis 60. Thus, as can be seen in FIGS. 2 and 3, axis 62, fixed to the insertion head base plate 54, is constrained for motion in a circular path around axis 60. Moreover axis 70 on the insertion head base plate is movable in Y and Z by various combinations of selected magnitudes of extension of the servo struts 66,68. The entire insertion head base plate, together with the traversing carriage, is movable in X by operation of motor 28 and screw 24, whereby three dimensions of linear motion are available to the insertion head base plate, which of course can also rotate around axes parallel to X. The described arrangement avoids the relative lack of stability and relative lack of rigidity, giving rise to imprecision and increased demands on tolerances, that are inherent in the common three axis linear drive. The pivotal connections which mount the base plate for motion in Y and Z afford significantly greater rigidity and stability and provide tolerances that are easier to attain for the desired precision of motion in Y and Z to align the wire contact with the selected one of the closely spaced connector apertures. The particular arrangement illustrated also facilitates programming of the desired motions and positions, by allowing the programmer to handle the positioning as if linear motions in Y and Z were accomplished, even though all Y,Z plane motions are accomplished by rotations driven by extension and contraction of the servo struts. The insertion head base plate is driven in Y and Z by a selectively controlled variation in the lengths of one or the other (or both) of the servo struts.

Figure 4:
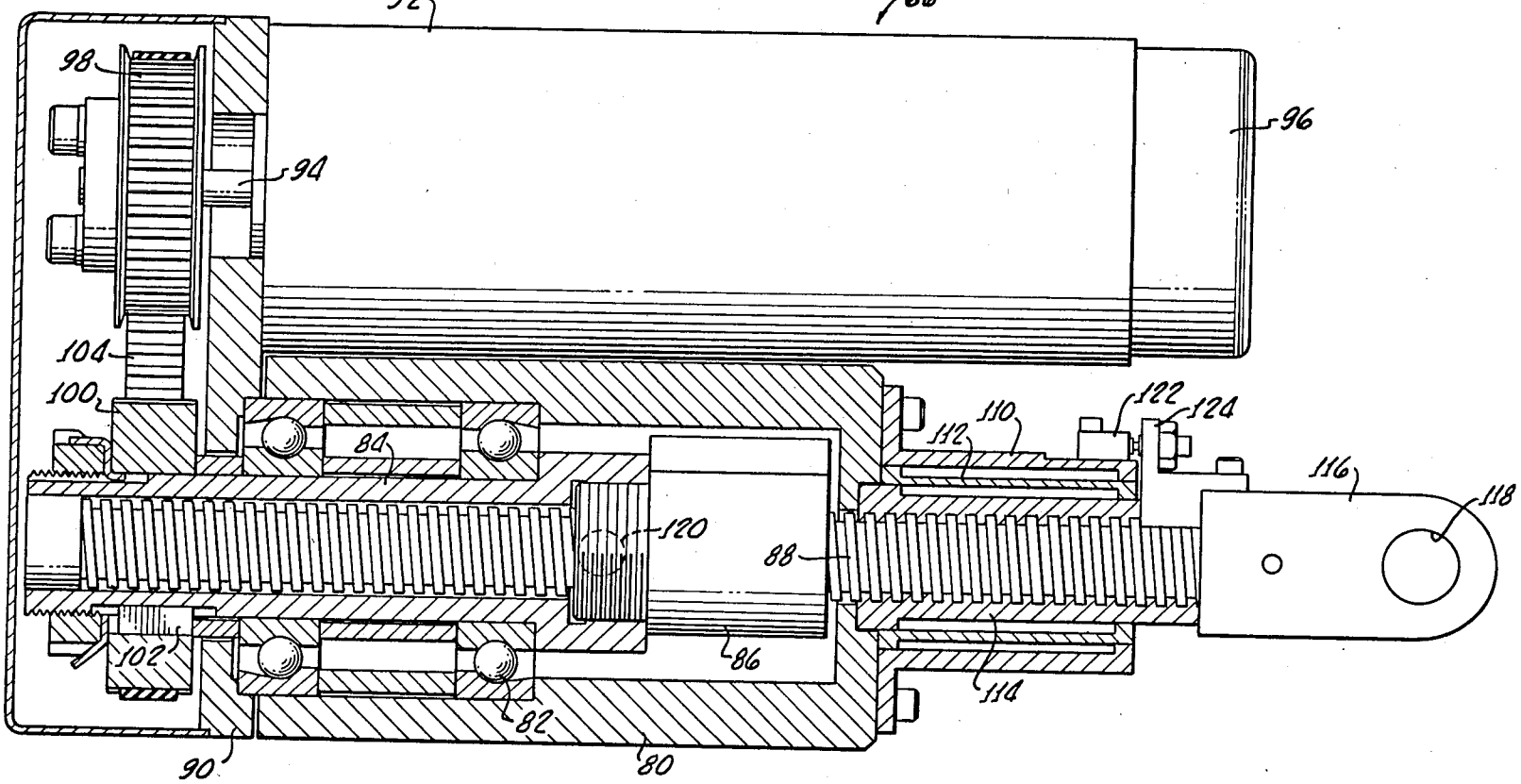
FIG. 4 is a longitudinal sectional view of one of the servo struts of FIG. 3.

FIG. 4 shows details of servo strut 66, which is identical to the other servo strut. Each servo strut includes a generally circular, cylindrical housing 80, in which is rotatably mounted on bearings 82 a hollow shaft 84, having fixed thereto an internally threaded sleeve or nut 86 which threadedly receives an externally threaded strut 88, which is slidably and snugly, but not threadedly, received by portions of the hollow shaft 84 extending rearwardly (toward the left in FIG. 4) of the nut 86. Housing 80 is fixedly secured to a base plate 90 upon which is mounted, along side of the housing 80, a bi-directional drive motor 92, having a drive shaft 94 to the forward end of which (toward the right as illustrated in FIG. 4) is secured a shaft rotation readout encoder 96 which generates electrical signals indicative of rotational position of the motor shaft to thereby effectively measure the length of the strut. On the rearward end of the motor shaft is fixed a pulley 98 which cooperates with a second pulley 100 fixed to the outer surface of hollow shaft 84 by means of a key 102 to receive a drive belt 104, which is entrained over both of the pulleys. Thus rotation of the motor rotates the hollow shaft and nut 86, which remain fixed against longitudinal motion within the housing 80. Rotation of nut 86 drives strut 88 longitudinally of the housing in one direction or the other. To protect threaded strut 88 as it extends from the housing, a plurality of mutually telescoping sleeve or barrel sections 110, 112 and 114 are mounted as illustrated, with outer sleeve 110 being bolted to the forward end of the housing, inner sleeve 114 slidably (but not threadedly) engaging the outer surface of the threaded strut 88, and intermediate sleeve 112 interposed between the inner and outer sleeves. A rod eye 116, apertured at 118, pivotally connects the servo strut at axis 70 to a pivot pin mounted on the base plate on axis 70. A pair of diametrically opposed outwardly projecting pivot shafts, such as the pivot shaft 120, shown in dotted lines in FIG. 4, are fixed to and project outwardly from housing 80 for pivotally mounting the strut housing 80 to side plates 40,41 on axis 72. A limit switch 122 fixed to outer sleeve 110 is actuated by an actuator arm 124 carried by rod eye 116 to signal the home or shortest position of the extensible servo strut.

Rotation of the bi-directional motor 92 in one direction or the other rotates hollow drive shaft 84 via the pulleys and belt 98,100,104 to drive threaded strut 88 in one direction or the other along the strut axis. As will be more particularly described below, the insertion head base plate 54 carries a wire drive assembly which grasps a wire 10 (FIG. 2) which is to be manipulated in a desired manner. The function of the linkage, including variable length servo struts 66,68 and fixed length links 56,58, is to move the axis of wire 10, which may deemed to be the working axis of the insertion head, in the Y and Z directions so as to position the head for retrieval and grasping of a fixedly positioned wire, and also to move the wire, once it has been grasped by the working head, to alignment with a selected one of the many densely packed apertures of the connector.

The lengths of each of the servo struts, one at a time or both together, are varied by sending suitable electrical signals to the servo strut motors by means of a conventional servo control system, which may include a suitable controller (not shown), also receiving motor shaft position signals from encoder 96. By varying the lengths of one or the other, or both, of the servo struts, axis 62 on the working head is caused to move in a circular arc about axis 60 by virtue of the pivot connections of the fixed length links 56,58. Operation of the servo strut motors forcibly changes the length of one or the other of the variable length links (e.g. the servo struts) or, more specifically, changes the distances between axes 60 and 70, and between axes 72 and 70. Changing these distances drives the working head axis, indicated in the drawings as the axis of wire 10 (the insertion head axis), to a selected position in Y and Z.

Table I, set forth below, illustrates some aspects of this motion, and shows exemplary coordinates Y and Z (in a suitable X, Y, Z coordinate system) of the wire axis in terms of corresponding lengths of the respective servo struts 68 and 66, the lengths of the struts being taken between the several points 60, 70, and 72. The Table shows increments of strut length that effectively produce linear coordinate motions in Y and Z, illustrating how the strut lengths may be varied to produce motion that is effectively parallel to the coordinate axes Y and Z, even though the wire drive assembly (carried on plate 54) is mounted to the traversing carriage solely by pivots.

TABLE I

| Y | Z | STRUT 68 | STRUT 66 |
|---|---|---|---|
| 0 | 0 | 7.557 | 7.299 |
| 1 | 0 | 8.108 | 8.071 |
| 0 | 1 | 8.176 | 6.522 |
| −1 | 0 | 6.834 | 6.791 |
| 0 | −1 | 6.753 | 7.893 |

The table of course is merely illustrative of a few of the servo strut lengths (the two rightmost columns) required to drive the head axis by different unit amounts in Y and Z (the two leftmost columns). These amounts may be readily defined in terms of strut lengths by calculations readily carried out manually or by digital computer program. Strut length calculations may be carried out in real time based upon given (desired) Y,Z position inputs of the head axis or a look-up table may be employed, entered by the desired X,Y coordinate positions of the head axis to extract the precomputed stored lengths of the respective servo struts.

WIRE DRIVE ASSEMBLY

Figure 7:
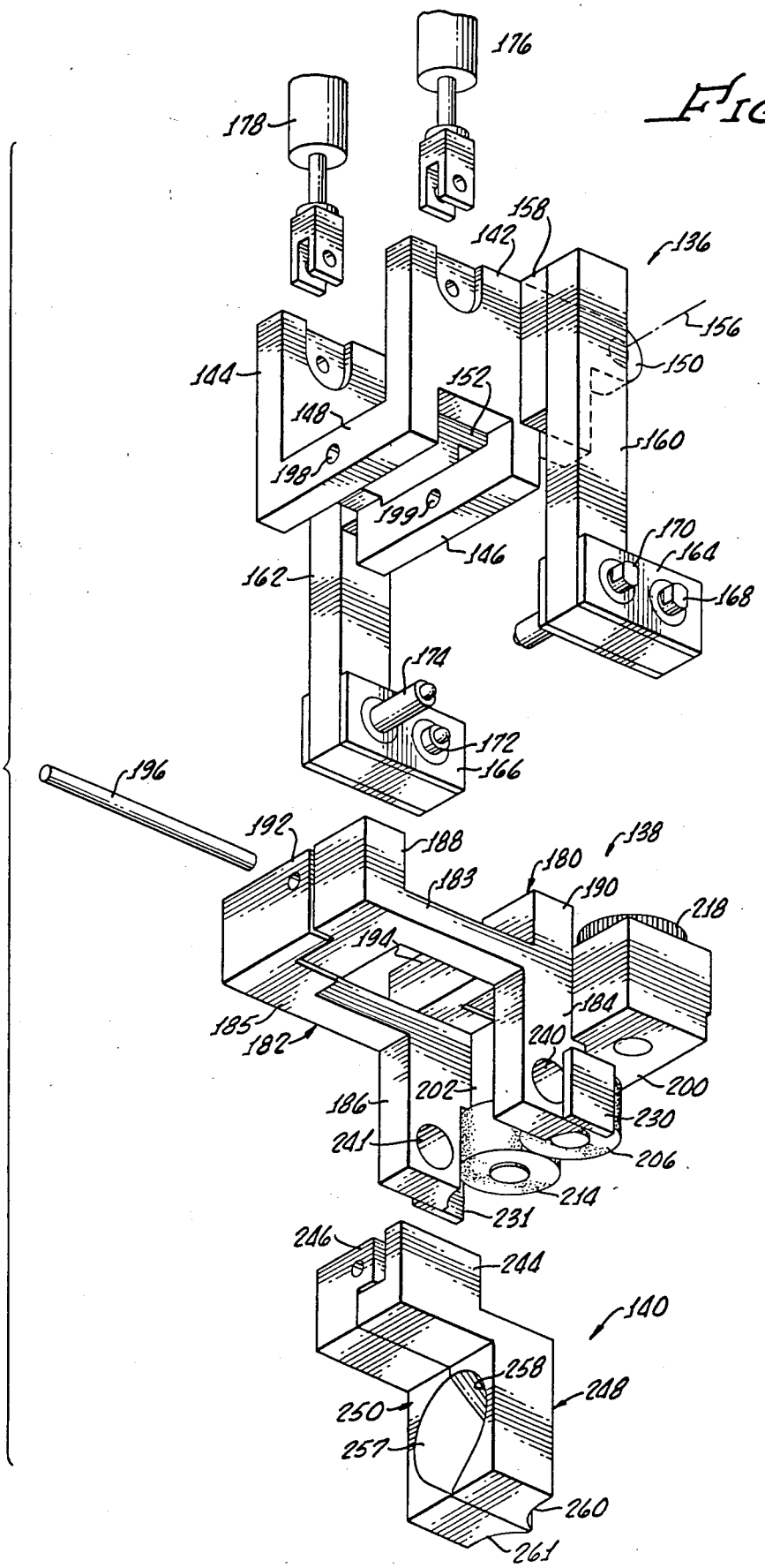
FIG. 7 is an exploded perspective view showing parts of the wire drive assembly.

Fixed to and depending from a lower portion of the insertion head base plate 54 is a turret support block 132 to which is pivotally mounted the wire drive assembly illustrated in exploded perspective in FIG. 7 as including a roller frame support or pitch yoke 136, a pair of wire drive roller frames 138, and a pair of funnel blocks 140. The pitch yoke, wire drive roller frames and funnel block are compactly interfitting to provide a short, compact assembly, although, as previously mentioned, these parts are shown elongated along the X axis in FIG. 2 for purposes of illustration. The wire drive roller frames and funnel blocks are also shown in exploded pictorial form in FIG. 8, with the mating parts of each turned outwardly, solely for purposes of illustation, to expose facing portions of these assemblies. Pitch yoke 136 comprises a generally U-shaped skeletal structure having side plates 142,144 from which depend, in mutually spaced relation, forward and rearward horizontally and transversely extending pivot support arms 146,148. It may be noted that the terms "horizontal" and "vertical" are relative only, and are representative of the various directions when the insertion head base plate is in a vertical plane.

Projecting forwardly from the side plates 142,144 are pivot arms 150,152 which straddle the turret block support and are pivoted at the forward ends thereof for motion about an axis 156 to a forward portion of the turret support block. Fixed to and outwardly spaced from the side plates 142,144, as by spacer blocks 158, are depending support bars, 160,162 which fixedly carry at their respective lower ends closing cylinder support plates 164,166. Support plates 164,166 respectively mount pairs 168,170 and 172,174 of closing air cylinders, each having a piston capable of being driven inwardly upon the selective feeding of air to a rear portion of the respective air cylinders. A pair of pitch drive air motors 176,178 (see FIG. 19) are pivoted to the insertion head base plate at their upper ends and include vertically reciprocable piston rods pivoted at their lower ends to rear portions of side plates 144,142 respectively. Actuation of the pitch motors moves the entire wire drive assembly frame about pitch axis 156 between the solid and dotted line positions illustrated in FIGS. 5 and 6.

Wire drive roller frames 138 include first and second substantially inverted L-shaped frame members 180,182 (FIG. 8*a*) having horizontally and vertically directed legs 183,184 and 185,186. Fixed to forward and rear ends of the horizontal legs 183,185 are mating pairs of hinge leaves 188,190 and 192,194, which pivotally receive a pivot pin 196 (FIGS. 2, 7, 10 and 12) which extends through apertures in the hinge leaves 192,194 and 188,190 and also through centrally located apertures 198,199 in depending arms 148,146 of the roller frame support 136. Thus the roller frame parts are pivotally mounted for motion between closed and open positions illustrated in FIGS. 12 and 13 respectively.

Fixedly carried on forwardly facing upper ends of the vertically directed wire drive roller frame parts 184,186 respectively are roller bearing blocks 200,202. Rotatably mounted in block 202 is a first roller shaft 204 (FIG. 12) carrying at its lower end a first resilient roller 206, and at its upper end a gear 208 which meshes with a second gear 210 mounted on the upper end of a second shaft 212 which is rotatably mounted in roller block 200 and carries at its lower end a second resilient roller 214. Block 200 also rotatably mounts a drive shaft 216 fixedly carrying a drive gear 218, which meshes with gear 210, and which is connected at its upper end by a universal joint 220 to the lower end of an extensible splined shaft 222, which in turn is connected by a universal connection 224 to the drive shaft of a roller drive motor 226 mounted on a bracket 228 (FIG. 2), fixedly carried by the insertion head base plate. The arrangement is such that the axis of the roller drive frame pivot part 196 is aligned with the upper mating corners of the meshing gears 210, 208 so that these gears are readily engaged when the roller frame parts are moved to the closed position of FIG. 12.

Figure 12:
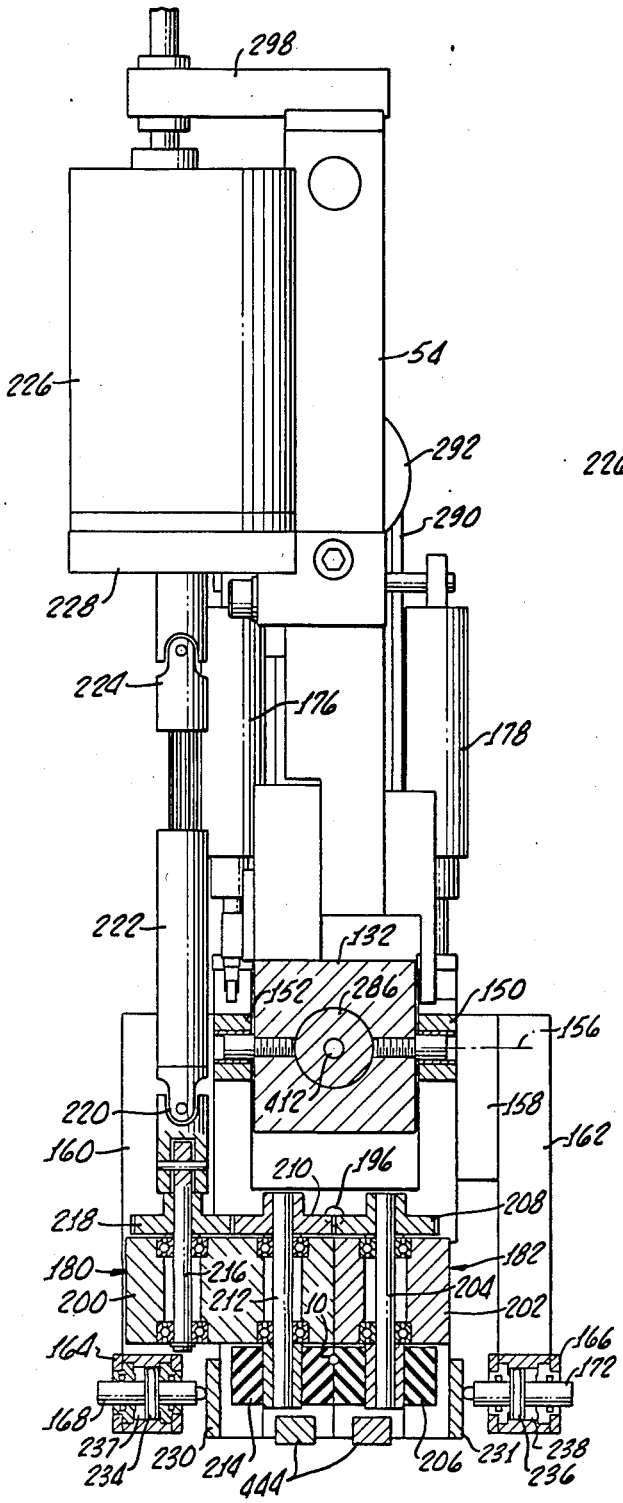
FIGS. 12 and 13 are sections taken on lines 12—12 of FIG. 6 showing the wire drive roller frame parts in closed and open positions respectively.
Figure 13:
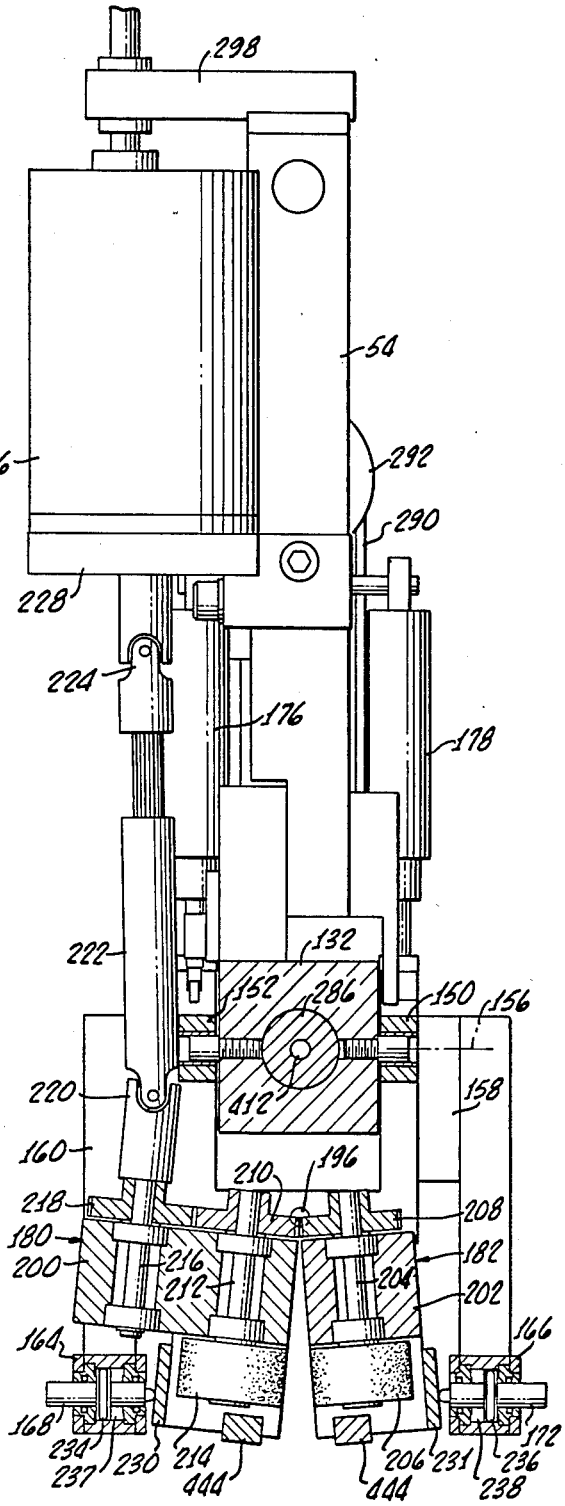

The forwardly positioned pair of closing air motors 168,172 carried by the roller frame support 136, have the inner ends of their drive piston rods bearing against outer surfaces of frame closing plates 230,231 respectively, carried by the lower ends of vertically directed roller frame legs 184,186. As best seen in FIGS. 12 and 13, the closing air motors 168,172 include spring return pistons 234,236 mounted in cylinders 237,238 so that pressurization of the cylinder will drive the pistons forwardly to forcibly pivot the wire drive roller frame parts to the closed position illustrated in FIG. 12. In this position a wire positioned between the rollers on the insertion head axis will be firmly grasped by the two rollers. Plates 230,231 are formed with apertures 240,241 which relatively loosely receive the second pair of closing air motors 170,174, as best seen in FIGS. 10 and 11.

Horizontal legs 183,185, together with the forward and rearward hinge leaves secured to these legs, form a generally rectangular opening (FIG. 7) into which are inserted upwardly directed legs 244,246 of the substantially Z-shaped funnel block parts 148,250, having downwardly directed funnel leg parts 252,254. Upwardly directed legs 244,246 are formed with interengaging hinge leaves apertured to receive the same pivot pin 196 that extends through the pitch yoke 136 and which pivotally mounts the wire drive roller frame parts to the pitch yoke. Thus the funnel block parts are pivoted for opening and closing motion on the same pivot axis as the wire drive roller frame parts. Downwardly directed funnel block part legs 252,254 are formed with mating aperture recesses 255,256 opening to the forward faces of these legs and diverging rearwardly to form mating guide funnel surfaces 257,258. Forwardly facing portions of the downwardly extending funnel block parts legs 252,254 are formed with circular recesses 260,261 which mate with the rollers 206,214 respectively to enable positioning of the funnel block parts close to the rollers. Laterally outer surfaces of funnel block part legs 252,254 extend within and betwen the wire drive roller frame legs 184,186, as can be seen in FIGS. 10 and 11, and are formed with facing and mating recesses 262,263 in which is captured a roller and funnel opening compression spring 264.

Figure 5:
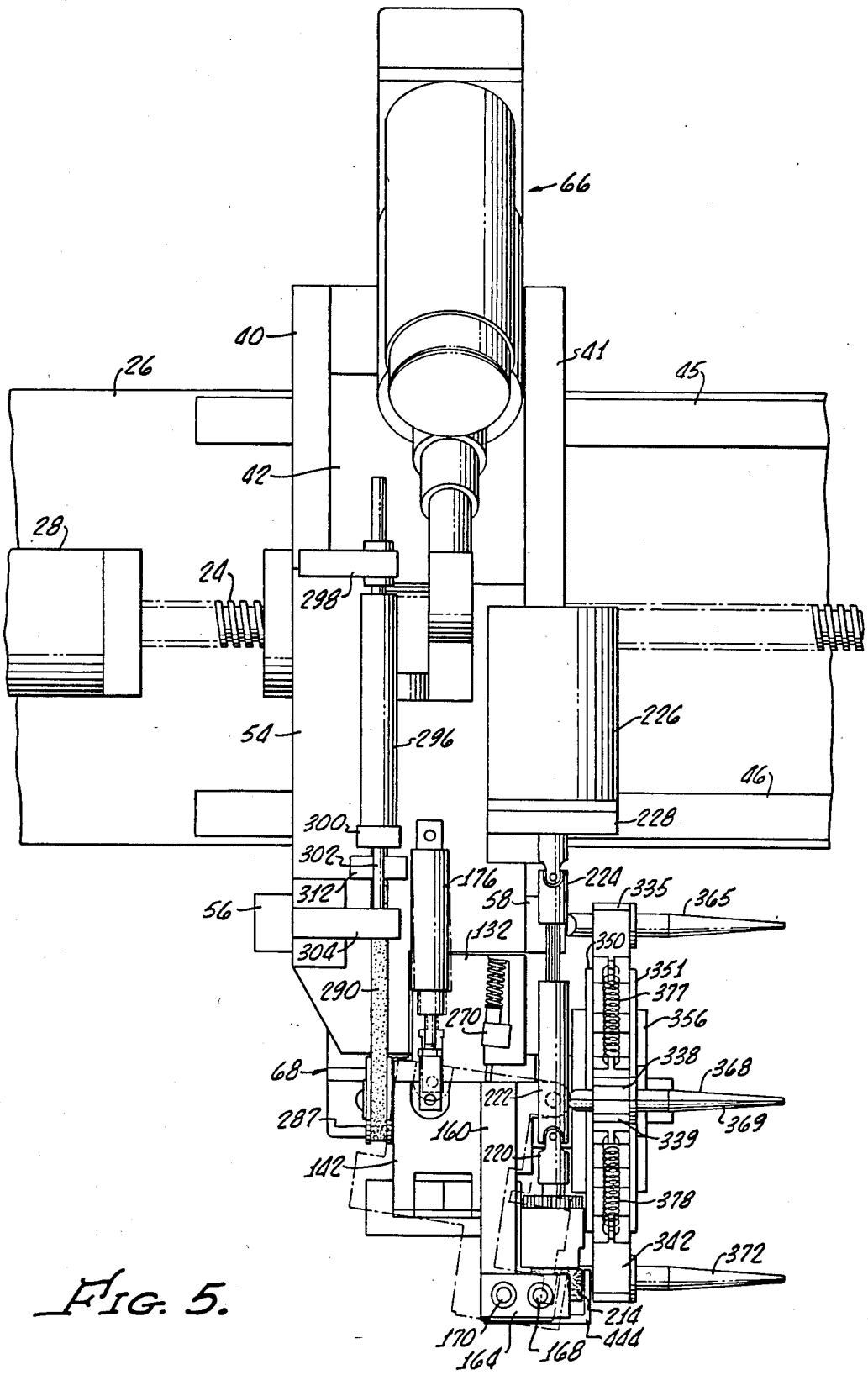
FIG. 5 is a side elevational view of the insertion head of FIG. 3.

A pitch yoke limit switch 270 (FIG. 5) is mounted on the turret support block 132 and includes a downwardly projecting actuator adapted to be contacted by the upper end of the pitch yoke side plate when the pitch yoke is pivotally retracted or moved in a clockwise direction, a viewed in FIG. 5. As will be more particularly described below, the pitch yoke is retracted through a relatively large angle illustrated in dotted lines in FIG. 5 for one purpose (clearance of a rotating quill turret to be described below) and retracted through a much smaller angle for a second purpose (a pull test), whereby the switch 270 may be of the type that will provide an output signal upon the attainment of one or the other of two positions. In the alternative, two different limit switches are provided.

It will be seen that actuation of the pitch drive motors 176,178 will pivot the roller frame support 136 and thereby pivotally move the entire wire drive assembly including the wire drive roller frame parts and the funnel block parts. Release of air from all of the closing air cylinders 168,172, 170 and 174 allows opening spring 264 to spread apart the parts of both the funnel block and the wire drive roller frame. Closing of these is individually actuated, that is, application of air to the funnel closing cylinders 170,174 will operate to close the funnel parts. But, because these cylinders extend through the holes 240,241 in the wire drive roller frame, this actuation will not operate to close the roller frame parts which, under such condition, may be spread apart by the insertion of a relatively large wire between the rollers. The roller frame parts are independently driven closed by application of pressurized air to the cylinders of closing air motors 168,170, of which the pistons bear directly upon the wire drive roller frame plates 230,231. Thus the rollers are free to spread apart without spreading the funnel parts when a contact with a large shoulder or flange is inserted or when a larger diameter wire is inserted. Both the resilience of the roller surfaces and the independent pivoting enable the rollers to firmly grasp wires and contacts of various configurations. Even in the presence of closing force exerted by roller closing motors 168,172, rotation of the rollers to grasp and draw a contact between them is sufficient to slightly spread the rollers as much as required to enable the resilient roller surfaces to receive the contact, so that the force of the closing cylinders 168,172 causes the rollers to securely grasp a contact or wire. However, when air is released from all four cylinders, operation of the opening spring 262 acts directly upon the funnel block parts to open these, and because these bear on the inner facing surfaces of wire drive roller frame legs 184,186, the spring operates to simultaneously spread the roller frame parts apart.

QUILL TURRET

Journaled in turret support block 132 on bearings 280,282 (FIG. 6), is a turret drive shaft 286 having a circular turret base 288 fixedly secured to its forward end. Shaft 286 is rotated by a pulley 287 (FIG. 2) over which is entrained a belt 290 guided and positioned by an idler pulley 292 rotatably mounted in the insertion head base plate 54. A first two position turret drive air motor 296 is connected between a fixed bar 298 on the base plate 54 and a vertically movable bracket 300 slidable vertically on a rod 302 carried by a second bracket 304, fixed on insertion head base plate 54. A second two position turret drive motor 310 mounted on the driven bracket 300 has its drive rod extending through bracket 300 and connected to a belt drive tongue 312 which is fixed to belt 290. Accordingly, four different positions of the belt 290 are provided by operation of the two air motors 296 and 310 individually or together, with motor 296 providing first and second positions of the belt, and motor 310 when combined with the motor 296 providing third and fourth positions. Thus the turret base 288 can be moved to any one of four positions, which are each signaled by actuation of a turret position switch 314 (FIG. 6) carried on turret support block 132 and operated by an actuator 316 on a bolt 318 extending through the turret base.

Figure 6:
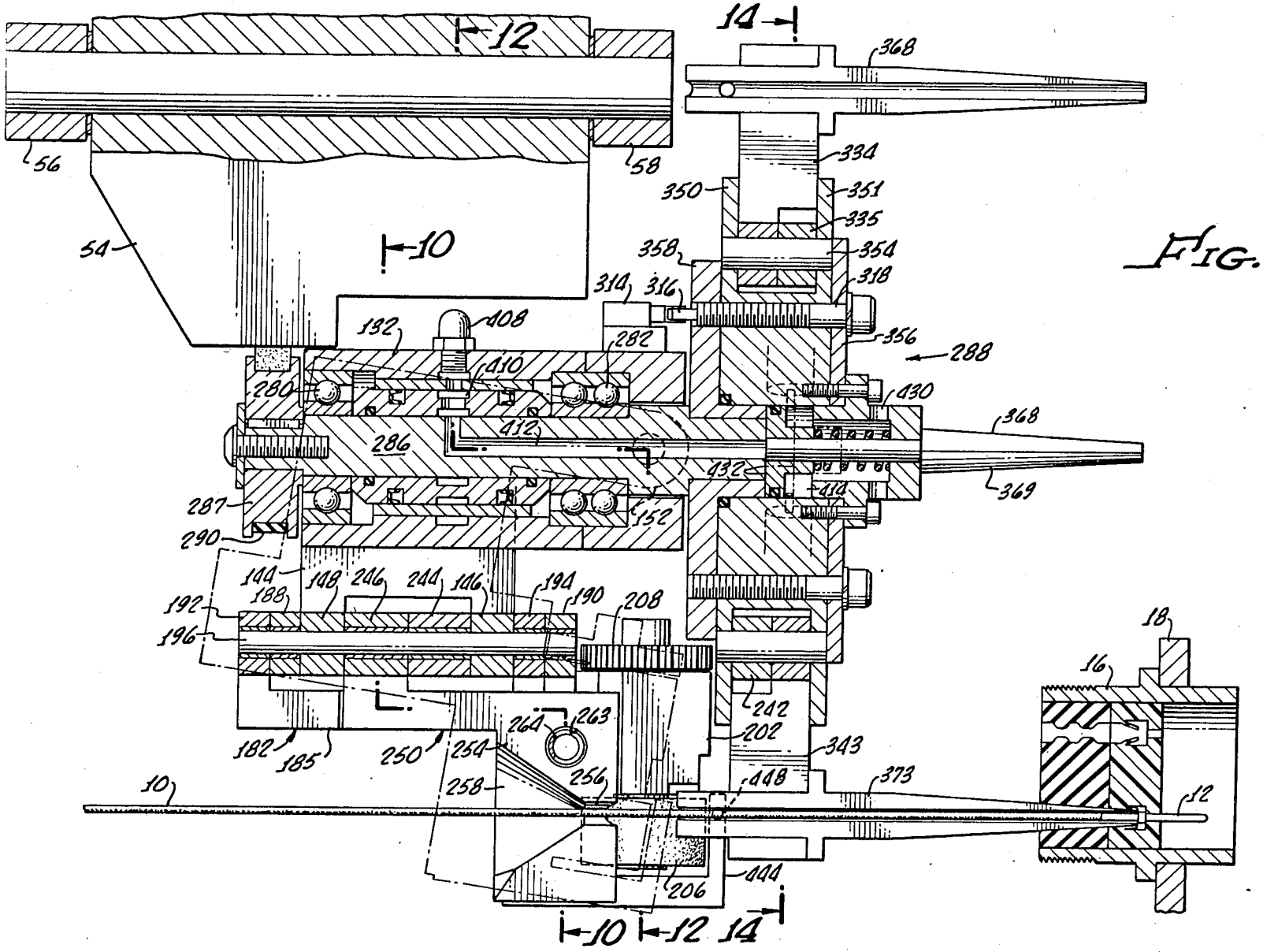
FIG. 6 is an elevational sectional view showing portions of the insertion head.

Mounted on the turret base 288, and equally spaced around the periphery thereof, are four pairs of quill bases, such as quill base pairs 330,331, 334,335, 338,339 and 342,343 (FIG. 14). The parts of each base pair, such as parts 334,335, are captured between a pair of axially spaced peripheral flanges 350,351 (FIG. 6) on the turret base 288 and freely pivoted to such flanges on a pivot pin 354 held in place on the turret base by an outer plate 356 and an inner plate 358, which are bolted to the front and rear faces of the turret base. Fixedly mounted to the respective parts of a each pair of quill bases are quill halves, such as quill halves 360,361, 364,365, 368,369 and 372,373 which project rearwardly of the turret base, as seen in FIGS. 6 and 9, and are suitable curved, as best seen in FIG. 9, to mate closely with the pair of closed rollers. The quill base parts are urged to the open position about their pivotal connections to the turret base flanges 350,351 by tension springs 376, 377, 378 and 379, which are connected to ears, such as ears 380,381 on quill bases 331 and 343 respectively, thereby tending to urge all of the quill parts to an open position, illustrated in dotted lines in FIG. 14, for quill parts 372,373.

The quill parts are driven to the closed position, illustrated in solid lines in FIG. 14 by means of eight air motors 382,383, 386,387, 390,391 and 394,395. Each air motor includes a cylinder mounting a piston which carries a ball, such as balls 398,399, for cylinders 386,387, which bear upon arcuate surfaces 402,404 positioned laterally outwardly of the pivot point of the quill base parts, so that upon air driven extension of the cylinders the balls are driven against the arcuate surfaces of the quill base parts, to drive the two parts in opposite directions about their common pivot, thereby to close the quill halves.

To operate the quill closing cylinders, pressurized air is admitted to a fitting 408 (FIG. 6) in turret support block 132, which communicates with an annular peripheral passage 410 in the turret drive shaft 86. Passage 410 is in communication with a longitudinal passage 412 in the turret drive shaft, which communicates with a centrally positioned manifold 414 located in the hub of the turret base 288, and communicating with each of the quill closing cylinders by means of radially directed passages 416, 417, 418, 419, 420, 421, 422 and 423 (FIG. 14). Manifold 414 is normally in communication with outside atmosphere via passages 430 in the turret hub. This enables rapid exhaust of air from the quill closing motors. The exhaust path of this air is blocked by means of a spring urged slidable piston 432 which is driven forwardly (toward the right as shown in FIG. 6) by air pressure in passage 412, thereby providing communication between passage 412 and the manifold 414. Piston 432 is spring urged toward the left to the position illustrated in FIG. 6, in which position it blocks flow of air from passage 412 to the turret drive cylinders and allows exhaust from the cylinders, thereby allowing the opening springs to open the quill parts. Upon pressurization of passage 412, piston 432 is driven toward the right to clear the ports that provide communication between manifold 414 and the quill closing cylinders, and thus all quills are simultaneously closed when pressurized air is applied to fitting 408.

OPERATION

With a wire 10 protruding from a reel 30 that is fixedly held on support 32 and with a connector 16 fixedly mounted on the carousel 18 ready for insertion of a contact on the end of the wire into a selected aperture, the traversing head may be assumed to be in a home position, with the head fully retracted in X (toward the left as viewed in FIG. 1) and the servo struts in home or shortest position. The pitch yoke is vertical, or in its forward position, and the funnel block parts and wire drive roller frame parts are closed.

The first step in the operation is to move the insertion head so as to cause the rollers to grasp a wire and enclose its slender, fragile terminal in the protective quill. Then the insertion head, with the grasped and enclosed wire, is moved to position the protective quill at the connector. The free end of the protective quill is positioned at, or in some cases slightly penetrating, the selected aperture of the connector, whereupon the rollers are rotated to drive the wire forwardly from the rollers, through the protective quill, and into the connector for connection thereto.

Thus, initially the entire head is traversed in X by operation of motor 28 to enable the head to clear a wire on the reel and the wire drive assembly is simultaneously caused to move, relative to the traversing carriage 22, in Y and Z to achieve alignment of the head axis (which is defined by the axis of the funnel, a common tangent to the closed rollers, and the axis of a properly positioned quill). As previously described, the wire drive assembly is moved in Y and Z by independent control of the lengths of the two servo struts. If a different quill is to be selected, the turret is rotated by actuation of turret drive air motors 296,310 to roughly position the selected quill in alignment with the rollers. Before rotating the turret, the wire drive assembly is retracted by operation of the pitch motors to enable the rearwardly projecting parts of the quill to clear the rollers as the turret rotates. Limit switch 270 may be employed to signal both retraction of the pitch yoke to clear the turret and to signal failure of a pull test, as described below. After turret rotation and with the rollers open, the pitch yoke and the wire drive roller frame and funnel blocks carried thereby are pivoted forwardly to the vertical position, and the funnel and roller parts are then closed to finally and precisely position the quill and turret by contact of the closing rollers with the quill end. As the insertion head moves in X, Y and Z to fetch the wire 10, the turret rotation and related operations may be carried out. The roller rotation also may be started during motion of the wire drive assembly to cause the wire end and its contact to be inserted into the closed funnel parts and be guided thereby along a common tangent to the closed rotating rollers for capture by the wire drive assembly. The exterior of the rollers is formed of a firm but resilient material that deforms as the contact is drawn between the rollers while the rollers are pressed together by the closing pistons. Rotation of the rollers is continued until the contact is positioned wholly within the quill. This position is signaled, for example, by a pneumatic sensor having sending and receiving conduits 440,442 (FIG. 9) on either side of the aligned turret. Sensor conduits 440,442 are mounted on brackets 444 (FIGS. 5 and 6, only one of which is shown) carried by the respective funnel block parts so as to move therewith between retracted and forward positions and between open and closed positions. The sensor conduits are connected to send a jet of air across the quill through aligned apertures 446,448 in the closed turret halves. Presence of the wire end in the turret blocks flow of air and thus signals a predetermined position of the wire end contact in the quill. In this position the contact is within and fully protected by the quill, to ensure that no part of the contact extends beyond the forward end of the quill.

The insertion head can continue its traverse in X, Y and Z while the rollers are rotating to grasp the wire and drive it into the protective quill. Motion of the head in X, Y and Z toward the connector may start as soon as the sensor 440,442 signals completion of the capture of the wire and contact by the wire drive assembly. This motion, which unwinds the wire from the rotatably mounted reel 30, continues so as to align the quill with the connector hole and to position the end of the quill close to the face of the connector grommet. The apparatus may be photographed in this position by a fixedly mounted camera (not shown) to record this aspect of the operation.

In some situations, the quill end is inserted a very small distance into the selected hole of the connector grommet. When so inserted, the entire wire drive assembly is then vibrated or oscillated in Y and Z, namely in a number of different directions in the plane of the face of the grommet, directions, which extend radially of the axis of the hole in the connector, in order to ensure alignment of the grommet hole with the connector hole. Misalignment of the grommet hole may occur because of accumulation of small displacements of the grommet as prior wires are inserted into other grommet holes and slightly distort or stretch the grommet. Obviously various types of oscillatory motions may be employed. As an example, at present it is preferred to reciprocate the entire wire drive assembly in Y through a total lateral displacement of approximately sixty thousandths of an inch, and, while this Y reciprocation is occurring, to also, but more rapidly, reciprocate the head in Z through a total vertical displacement of about thirty thousandths of an inch, so that, in effect, the quill end and the wire will trace a sinusoidal path parallel to the Y axis and varying in amplitude along the Z axis.

Oscillation of the wire drive assembly provides a number of advantages. It allows the quill to be inserted in the midst of a group of densely packed wires that have already been connected to the connector so as to insert a contact into an aperture which was skipped (not filled) when a number of other connector apertures around it were filled with contacts. It permits the insertion of contacts into connector apertures to be accomplished in any selected order and does not require that after a number of wires have been inserted into the connector the next wire must be inserted adjacent a wire that has been previously inserted. In addition, as previously mentioned, the oscillation of the quill while the quill end is partly inserted into a connector grommet, ensures that the grommet aperture is aligned with the quill and thus is aligned with the connector aperture. Further, as will be explained below, the oscillation helps to secure some contacts that are difficult to connect.

With the quill end adjacent the connector, or partly inserted, the rollers, which have stopped rotating when the terminal reaches its position within the quill, are now further rotated a predetermined distance to drive the contact from the quill into its connection with the connector. Conveniently, the distance of longitudinal wire travel is controlled by use of a step motor for the roller drive motor and by counting increments of drive motor step rotation.

Having driven the wire and its contact into the connector to be firmly held thereby, a pull test is executed by operating the roller frame support pitch motors 176,178 to attempt to retract the entire wire drive assembly, but not the contact, a small amount as determined by pitch yoke limit switch 270 (FIG. 5). The force exerted in this retraction is relatively small. The rollers still retain a tight grasp of the wire, which is freely slidable within the quill still positioned at or partly inserted into the connector aperture. Accordingly, if a proper insertion has been completed, the contact connection resists the small test force, no retraction occurs, and there is no signal from the pitch yoke limit switch. If the contact connection is not secure, retraction does occur. This is signaled by the actuation of the pitch yoke limit switch which responds to the retracting pivotal motion of the pitch yoke.

Upon signaling an unsecure contact connection, a reinsertion sequence is initiated, and repeated several times (five, for example) in order to further attempt to drive the wire contact into a proper and secure connection within the connector. In this reinsertion sequence the wire is in effect drilled or hammered into the connector aperture. While the entire wire drive assembly is vibrated in Y and Z, as previously described, in its somewhat sinusoidal pattern, the rollers are driven forwardly and rearwardly to effectively reciprocate the wire axially, advancing it by twelve small increments of roller rotation and retracting it by eight. Thus the roller is rotated in a forward direction by a selected amount and then rotated in a reverse direction a smaller amount. This advance and retraction of the wire is repeated so as to effect a total or net advance of the wire through a distance sufficient to effect a full insertion of the contact within the connector. The pull test is then repeated, thereby completing one cycle of drilling the wire and testing. If the pull test fails, the cycle of drilling the wire and pull testing is repeated. After completion of five such cycles without success, the attempt to insert this particular wire is aborted and the insertion head may be operated to either release the wire or to position the wire contact in a temporary storage position, such as for example, to insert the contact into a block of storage foam (not shown) that may be mounted on the carousel adjacent the connector. It has been found that this combination of "drilling" and quill oscillation will often result in secure connection of a contact that has not been properly connected upon its first insertion.

When the pull test is passed, the pitch yoke, carrying the wire drive roller frame and funnel parts is fully retracted and the rollers are opened by releasing air pressure to the closing cylinders. The quill initially remains closed since it may be inserted partly in the connector aperture. The entire insertion head is then retracted in X to withdraw the quill from the aperture. The quill parts are opened, and the head may be moved laterally, upwardly for example, to release the wire from the quill, rollers and funnel. The wire now has contact end connected to the connector and its other end still on the reel. When the insertion head has moved laterally of the wire to clear the wire, the reel with the non-inserted wire end may be then moved to place it on a stack of reels on the carousel. If the next wire requires a different quill, the turret is rotated, the pitch yoke is moved forward to its vertical position and the rollers and funnel parts closed to precisely position the newly selected quill. The apparatus is now in position to fetch and insert another wire contact.

There have been described an improved apparatus and method for inserting an end of a wire into an aperture of a multi-pin connector wherein the insertion head is more precisely positioned with greater rigidity and stability and wherein unique mounting configuration and motions of the head and its various parts allow for increased reliability, repeatability, precision, efficiency and speed of operation. Greater flexiblity of operation, enabling use of the apparatus and method with wires of different diameters and different contact size and configurations, is provided by the turret that allows selection of one of a number of different size quills, and the combination of pivoted roller blocks and wire drive roller frame parts which allows the rollers to be spread apart by the entry of a large diameter wire between the rollers along a common tangent even while the funnel block parts are in closed position to properly guide the wire to the rollers. Thus the rollers may be opened either independently, or together with the funnel blocks and rollers, and funnel blocks may be closed independently. The pivotal motion of the pitch yoke for conducting a pull test minimizes the mass required to be moved in this operation, and this same pivoted structure facilitates precise positioning of a selected one of the turret mounted quills relative to the rollers.

The foregoing detailed description is to be clearly understood as given by way of illustration and example only, the spirit and scope of this invention being limited solely by the appended claims.

What is claimed is:

1. Apparatus for inserting the end of a wire into a connector comprising a support, mounting means on said support for mounting a connector having at least one connector aperture for receiving a wire end, an insertion head mounted to the support for motion relative to said mounting means, a roller frame support mounted to the insertion head for motion between an insertion position and a retracted position, first and second wire drive roller frames having first and second wire drive rollers rotatably mounted therein respectively, said wire drive roller frames being mounted to said roller frame support for relative motion between a first position in which the rollers of said frames are mutually displaced and a second position in which said rollers are mutually juxtaposed for grasping and driving a wire positioned therebetween, and means on said roller frame support for guiding a wire end to said rollers, said means for guiding comprising first and second funnel parts defining mating portions of a guide funnel positioned to guide a wire to and between said rollers, said funnel parts being movably mounted to said roller frame support for motion between a first position in which the funnel parts are mutually displaced and a second position in which the funnel parts are mutually juxtaposed to provide a guide funnel adjacent said rollers.

2. The apparatus of claim 1 wherein said insertion head is mounted to the support by a linkage assembly, said linkage assembly comprising linkage means for connecting first and second mutually spaced axes on said support to third and fourth mutually spaced axes on said insertion head, said linkage means comprising a first link pivotally connected to said support and insertion head at said first and third axes respectively, a second link pivotally connected to said support and insertion head at said first and fourth axes respectively, a third link pivotally connected to said support and insertion head at said second and fourth axes respectively, said second and third links each having a variable length, all of said axes being mutually parallel.

3. The apparatus of claim 2 including actuator means for varying the length of at least one of said second and third links.

4. Apparatus for inserting the end of a wire into a connector comprising a support, mounting means on said support for mounting a connector having at least one connector aperture for receiving a wire end, an insertion head mounted to the support for motion relative to said mounting means, a roller frame support mounted to the insertion head for motion between an insertion position and a retracted position, first and second wire drive roller frames having first and second wire drive rollers rotatably mounted therein respectively, said wire drive roller frames being mounted to said roller frame support for relative motion between a first position in which the rollers of said frames are mutually displaced and a second position in which said rollers are mutually juxtaposed for grasping and driving a wire positioned therebetween, means on said roller frame support for guiding a wire end to said rollers, a protective quill mounted to said insertion head and having an end thereof positioned adjacent said rollers at a side thereof remote from said means for guiding, said quill having first and second parts mounted for motion between a first position in which said quill parts are displaced from one another and a second position in which said quill parts are mutually adjacent to form a protective sheath for a wire end, and a quill turret, said quill being mounted on said turret, a second quill mounted on said turret, means for mounting said turret to said insertion head for motion between a first position in which said first mentioned quill is postioned adjacent said rollers and a second position in which said second quill is positioned adjacent said rollers, and means for rotating said turret to selectively position one or the other of said quills adjacent said rollers.

5. The apparatus of claim 4 wherein said second quill has an insertion end projecting from one side of said quill support, and a second end projecting from the other side of said quill support between said rollers when said one turret is in said second position, whereby movement of said wire drive roller frames to said second position will more precisely position said second quill in alignment with said rollers.

6. Apparatus for inserting a wire end into a connector comprising a support, an insertion head mounted on said support for motion toward and away from a connector into which a wire end is to be inserted, a pair of rollers mounted to said insertion head for motion between a first position in which said rollers are mutually adjacent to grasp a wire therebetween and a second position in which said rollers are displaced from one another, a pair of funnel parts mounted to said insertion head for motion between a first position in which said funnel parts are mutually adjacent to one another for guiding a wire end to and between said rollers and a second position in which said funnel parts are displaced from one another, and a pair of quill parts mounted to said insertion head for motion between a first position in which said quill parts are mutually adjacent to one another and adjacent to said rollers so as to receive a wire end grasped by said rollers and driven therefrom, and a second position in which said quill parts are mutually displaced from one another.

7. The apparatus of claim 6 including a quill base, a second pair of quill parts mounted to said base, said first mentioned pair of quill parts being mounted to said base at a position spaced from said second pair of quill parts, and means for mounting said quill base to said insertion head for motion between a first position in which said first mentioned quill parts are adjacent said rollers and a second position in which said second quill parts are adjacent said rollers.

8. The apparatus of claim 7 wherein rear portions of the quill parts of said first pair of quill parts extend partly between said rollers when the rollers are in their second position, and including means for aligning the parts of said first pair of quill parts with said rollers, said means for aligning comprising said rollers and said quill parts rear portions, whereby motion of said rollers to said first position contacts said quill part rear portions and aligns said first pair of quill parts with said rollers in their second position.

9. The apparatus of claim 6 wherein said rollers are positioned between said pair of funnel parts and said pair of quill parts whereby a wire end may be guided longitudinally by said funnel parts to and between said rollers and may be driven by said rollers into said quill parts, and whereby said rollers, funnel parts and quill parts may be laterally displaced from a wire which has been grasped between the rollers and received by said quill parts.

10. Apparatus for inserting a wire end into a connector aperture comprising a support, an insertion head traversing carriage mounted on said support for motion in a first direction, an insertion head base, means for mounting the insertion head base to the carriage for motion in a plane perpendicular to said first direction, and a wire drive assembly carried by said insertion head base, said wire drive assembly comprising a roller frame support connected to said insertion head base, first and second wire drive roller frame parts carrying first and second rollers respectively, said roller frame parts being pivoted to said roller frame support for motion between a first position in which said rollers are adjacent to one another to grasp a wire therebetween and a second position in which said rollers are mutually displaced to allow a wire to move laterally from between said rollers, first and second funnel parts pivoted to said roller frame support for motion between a first position in which said funnel parts are adjacent each other and adjacent the rollers to form a guide funnel for guiding a wire to and between said rollers, and a second position in which said funnel parts are mutually displaced from one another, a quill carrier, a plurality of quills mounted on said quill carrier, each said quill comprising first and second quill parts movably mounted to said carrier for motion between a first position in which parts of each quill are adjacent one another to provide a wire end protective sheath and a second position in which parts of each quill are displaced from one another to allow a wire to move laterally from between said quill parts, means for mounting said quill carrier to said insertion head base for motion between a plurality of discrete positions in each of which a different one of said quills is positioned adjacent to and in alignment with said rollers, quill drive means for moving said quill parts between said first and second positions thereof, means for moving said quill carrier to a selected one of said discrete positions, roller drive means for rotating said rollers, and means for driving said wire drive roller frame parts and said funnel parts between said first and second positions thereof.

11. The apparatus of claim 10 wherein said roller frame support is pivoted to said insertion head base for motion between a first position in which said rollers extend partly around the end of the one of said quills positioned in alignment with said rollers and a second position in which said rollers are retracted from the end of said one quill to enable the quills to clear the rollers during quill carrier motion.

12. The apparatus of claim 11 wherein said wire drive roller frame parts include portions bearing against outer surfaces of said funnel parts, and including means for moving said funnel parts to said second position and thereby moving said wire drive roller frame parts to their second position.

13. The apparatus of claim 12 including first and second piston means carried by said roller frame support and bearing against outer surfaces of said wire drive roller frame parts to move said wire drive roller frame parts to said first position, and third and fourth closing piston means carried by said roller frame support and connected with said funnel parts for moving said funnel parts to said first position.

14. The apparatus of claim 13 including means for simultaneously opening and closing all of said quill parts, said last mentioned means comprising a plurality of tension springs respectively interconnecting one part of one quill with an adjacent part of an adjacent quill for urging such parts of adjacent quills toward one another to open the quills, a plurality of air motors each connected at one end to a central portion of said quill carrier and at the other end to one of said quill parts for pivoting the parts of each of the respective quills toward one another to said first position thereof, and means for simultaneously energizing or deactivating said air motor means.

15. The apparatus of claim 10 including means for independently moving the funnel parts to the first position thereof independently of the wire drive roller frame parts, said wire drive roller frame parts being movable to the second position thereof independently of motion of the funnel parts to the second position thereof.

16. The apparatus of claim 10 wherein said means for mounting the insertion head base to the carriage comprises a first link of effectively fixed length pivoted to and between said base and carriage, a first extensible link pivoted between said carriage and said base, a second extensible link pivoted between said carriage and said base, and power means for selectively changing the lengths of said first and second extensible links.

17. The apparatus of claim 16 where at least one of said extensible links comprises a housing, first and second threadedly interengaged and mutually extensible parts mounted in said housing, and motor means mounted on said housing for effecting relative rotation of said first and second threadedly interengaged parts.

18. Apparatus for inserting a wire end into a connector aperture comprising:

an insertion head base, a pitch yoke pivotally mounted to the base for motion between a forward position and a retracted position about a pitch axis, a pair of wire drive roller frames pivoted to the pitch yoke about a common longitudinal axis for motion between a closed position and a laterally open position, first and second rollers rotatably carried by said wire drive roller frames, means on said base for rotating said rollers, and a pair of funnel blocks pivoted to said pitch yoke about an axis coaxial with said longitudinal axis for motion between closed and laterally open positions, each said funnel block having a tapered surface cooperating with the tapered surface of the other funnel block to form a wire guide entry funnel.

19. The apparatus of claim 18 wherein said wire drive roller frames include depending legs, said funnel blocks being positioned between said depending legs, and including means for separating said funnel blocks to thereby separate said wire drive roller frames.

20. The apparatus of claim 19 including means for closing said funnel blocks independently of said wire drive roller frames.

21. The apparatus of claim 20 wherein said means for closing said funnel blocks comprise first and second piston means connected between said pitch yoke and said first and second funnel blocks respectively.

22. The apparatus of claim 21 including means for closing said wire drive roller frames comprising third and fourth piston means connected between said pitch yoke and said first and second wire drive roller frames respectively.

23. The apparatus of claim 18 including a support, and positioning means for movably mounting the insertion head base to the support, said positioning means comprising linkage means for connecting first and second mutually spaced axes on said support to third and fourth mutually spaced axes on said base head, said linkage means comprising a first link pivotally connected to said support and base head at said first and third axes respectively, a second link pivotally connected to said support and base head at said first and fourth axes respectively, a third link pivotally connected to said support and base head at said second and fourth axes respectively, said second and third links each having a variable length, all of said axes being mutually parallel.

24. The apparatus of claim 18 including a support, and positioning means for movably mounting the insertion head base to the support, said positioning means comprising a first link of effectively fixed length pivoted to and between said base and support, a first extensible link pivoted between said support and said base, a second extensible link pivoted between said support and said base, and power means for selectively changing the lengths of said first and second extensible links.

* * * * *